United States Patent [19]

Dutro et al.

[11] 3,948,153

[45] Apr. 6, 1976

[54] COUNT SEPARATOR FOR A STREAM OF OVERLAPPED ARTICLES

[75] Inventors: Orville V. Dutro, La Canada; Lyle V. Dutro, Altadena; Sherman H. Hewson, La Canada, all of Calif.

[73] Assignee: Mildred L. Taylor, Pasadena, Calif. ; a part interest

[22] Filed: July 12, 1974

[21] Appl. No.: 488,040

[52] U.S. Cl. ..... 93/93 C; 93/93 R; 271/189

[51] Int. Cl.[2] ..... B31B 1/96

[58] Field of Search.... 93/93 C, 93 R, 93 DP, 93 K, 93/93 D; 271/189, 190, 191, 192, 216, 229, 230, 256, 258, 182; 198/40; 214/6 DK

[56] References Cited

UNITED STATES PATENTS

| | | | |
|---|---|---|---|
| 3,313,221 | 4/1967 | Gubeli | 93/93 DP |
| 3,429,240 | 2/1969 | Kawai et al. | 93/93 DP |
| 3,543,651 | 12/1970 | Donahue et al. | 93/93 DP |
| 3,568,578 | 3/1971 | Fujishiro | 93/93 DP |
| 3,834,288 | 9/1974 | Behrens et al. | 93/93 DP |

FOREIGN PATENTS OR APPLICATIONS

| | | | |
|---|---|---|---|
| 218,302 | 1/1968 | Sweden | 271/189 |

*Primary Examiner*—James F. Coan
*Attorney, Agent, or Firm*—Donald D. Mon

[57] ABSTRACT

A separator for providing a gap between counted groups of previously overlapped articles of a stream of said articles. The separator includes a counter which counts the articles as they issue from the feed path. A spur path and an output path diverge from one another adjacent to a counting point at the counter. A diverter is adapted to divert articles to the spur path on command. Actuator means responsive to the completion of the count of articles causes the diverter to send articles to the spur path. Retention means is placed in the spur path to receive articles diverted into the spur path. Sensing means in the output path is responsive to the departure of the last article of a previously counted group to cause the retention means to transfer articles retained by it to the output path and to remove the diverter from its diverting position, thereby again to permit the passage of articles directly to the output path until a predetermined count is completed. The retention of articles on the retention means until response of the sensing means to the departure of the last article of an already-counted group causes a gap to exist between counted groups as they issue from the output path.

19 Claims, 13 Drawing Figures

ACT-UATOR

COUNT CONTINUES DEFLECTOR UP
SENSING MEANS DEPRESSED

VALVE ACTUATOR
COUNT REGISTER
PULSE
COUNTER
VALVE ACTUATOR
EX

RETENTION MEANS RETRACTED (IN SOLIDLINE)

COUNT SEPARATOR FOR A STREAM OF OVERLAPPED ARTICLES

This invention relates to a count separator for a stream of overlapped articles.

Especially in the printing industry, articles such as newspaper signatures and the like issue as an overlapped, shingled, continuous stream. The continuous overlapped stream is not a suitable form for subsequent handling of these articles, and it is necessary to separate the stream into groups of known count content so they can be stacked in a useful bundle. Counters, stackers and separators for this purpose are already known, but it has been the nature of development in this field to make them more complex, and ultimately to price them out of the reach of the small to medium-sized shop. It is an object of this invention to provide a count separator which can provide a spacing (sometimes called a "gap") between groups of counted articles from a stream of previously overlapped articles, which may then be gathered in stacks of predetermined size and content. Because this separator is intended for the smaller and medium-sized shop, where labor and investment capital must be conserved, the separator is made of elegant simplicity and ruggedness, and with optimally few and simple parts in order to minimize both the initial cost and cost of maintenance and repair.

It is an object of this invention to provide a separator which can receive an overlapped stream of articles, and to count the same into groups and to issue the same as groups of usually partially shingled bunches of a predetermined count. The user of the machine is able to utilize the gap as a visual indication of where one group ends and the other begins, and thereby manually or mechanically to handle the counted groups and convert them into tied bundles or to any other application to which the user desires to put the counted groups of articles.

Because these streams are not uniform, sometimes papers will be missing, or the spacing between their leading edges will vary from paper to paper. Accordingly, known separators which work on the stream well downstream of the counting point and require anticipation of following means have difficulty making an accurate count. It is an object of this invention to separate counted groups substantially adjacent to the counting point, thereby both simplifying the machine and making it more accurate.

It is another object of the invention to provide a separator in which the count is inherently accurate as a consequence of mechanically diverting the stream substantially adjacent to the counting point, whereby a quick response to a counting signal averts the risk of passing an article to the wrong group.

A separator according to this invention is adapted to receive articles as they issue from a feed path. It includes output conveyor means defining an output path, and retention means which overhang the output conveyor means to define a spur path. These paths diverge downstream from, and substantially adjacent to, the counting point where the counting is performed. Diverter means is provided for diverting articles to the spur path. Counter means counts articles passing the counting point. Diverter actuator means is responsive to the counter, and upon completion of the count, it causes the diverter to divert the next article to the spur path. Sensing means senses the departure of the last counted article from a location along the output path. Sensing responsive means is responsive to said sensing means which causes the retention means to transfer articles from the spur path to the output path when the signal is given by the sensing means that the output path is clear of articles at the location of the sensing means. The sensing means is placed downstream from where the articles are deposited on the output path by the retention means.

At the start of the count, the diverter means diverts the stream of articles to the spur path, while the output conveyor means conveys away the already-counted group of articles. The sensing means senses the presence of articles at its location until the last article of the already-counted group is past it, whereupon the sensing responsive means causes the said transfer and removes the diverter means from its diverting position, whereby subsequent articles from the feed path flow directly to the output path, completion of a predetermined count causing the cycle to repeat.

According to a preferred but optional feature of the invention, the retention means comprises a table which is disposed adjacent to and above the output path, and table shifting means which moves the table beneath the spur path or removes it therefrom, dropping the retained articles onto the output conveyor means when the table is removed.

According to another preferred but optional feature of the invention, the diverter means is pivotally mounted to the table and has a first position where it does not divert articles and another where it does, together with means to place the diverter in one position or the other.

The above and other features of this invention will be fully understood from the following detailed description and the accompanying drawings in which.

Figures 1, 2:
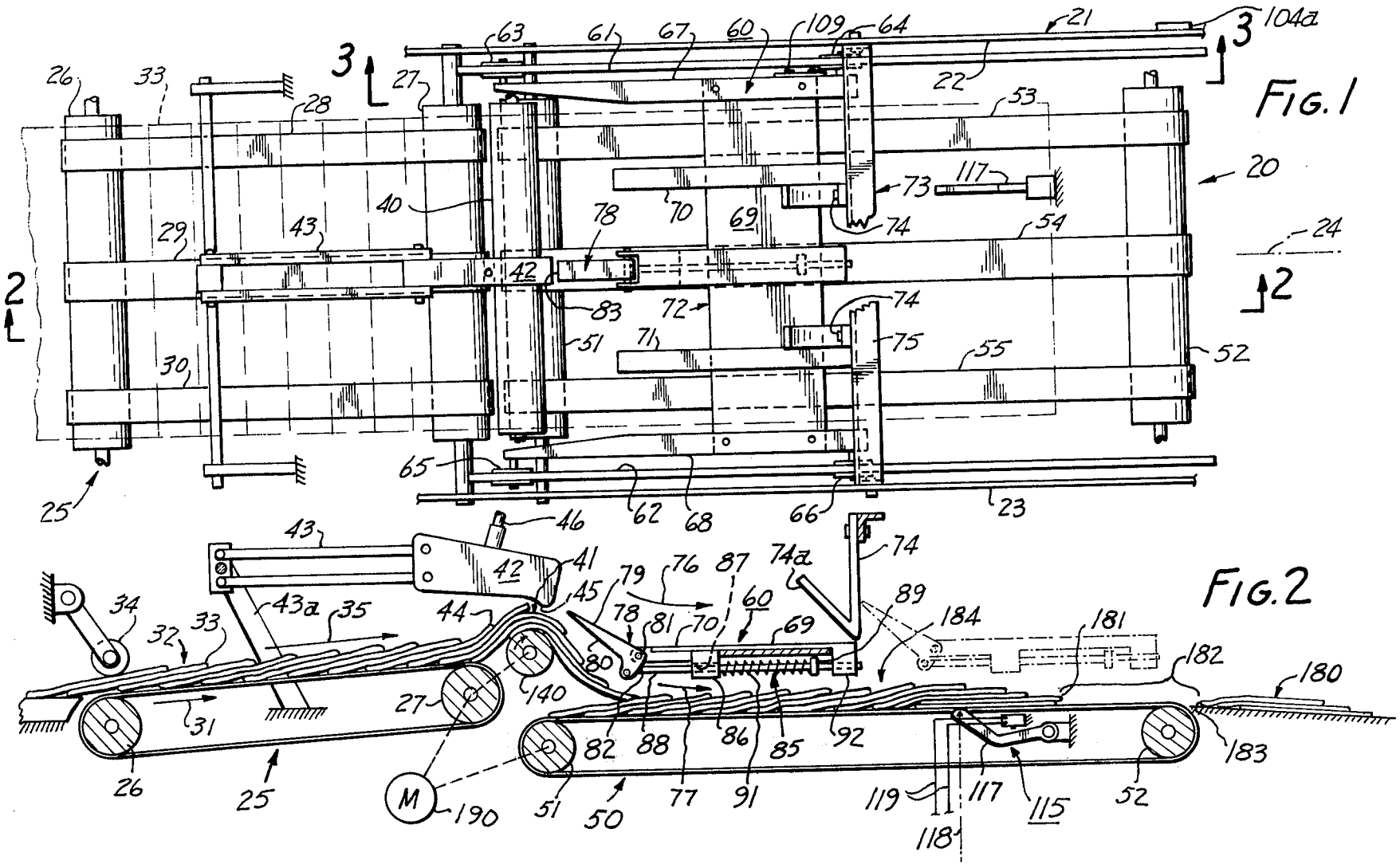
FIG. 1 is a top view of apparatus according to the invention taken at line 1—1 of FIG. 3.
FIG. 2 is a vertical cross-section taken at line 2—2 of FIG. 1.

In FIG. 1 there is shown the presently preferred embodiment of separator 20 according to the invention. It includes a frame 21 comprised of a pair of side plates 22, 23 which are attached to each other and are spaced apart from each other, one on each side of an axis 24.

An infeed conveyor means 25 includes a pair of rollers 26, 27 which support three conveyor belts 28, 29, 30 and drive them in the forward direction of stream indicated by arrow 31. The infeed conveyor means does not necessarily form part of the separator itself. It can instead be the issuing portion of a press or other feed device. The infeed conveyor means delivers a stream 32 of overlapped articles 33, shown as a shingled, overlapped stream. Pinch roller 34 rests against the top of the stream and presses articles against the roller 26 to give a more positive traction for transferring articles to belts 28, 29 and 30.

That portion of the stream path atop the infeed conveyor means is sometimes referred to as a feed path 35. A reference roller 40 is rotatably journaled to and extends between the side plates 22, 23. This roller is at a somewhat higher elevation than roller 27, and causes the articles to go over a "hump" as they pass it. This hump is established at a "counting point" 41 which is adjacent to a counter 42.

Counter 42 is mounted by a structure 43 attached to one of the side plates. The structure includes a parallelogram mounting 43, whereby the counter itself can rise and fall relative to the hump, still maintaining its angular alignment relative to the stream. This counter and mounting are fully shown in Dutro U.S. Pat. No. 3,737,666, issued June 5, 1973, entitled "Counter for a Stream of Overlapped Articles", to which reference is made for its full details, in particular to the deflector surface 45 and to the means whereby the passage of the edge of an article being counted provides a pulse which can be counted.

To summarize the function of the counter, the passage of an edge 44 (FIG. 1 herein) of an article past a reference part 45 (a deflector surface) of the counter will cause the counter to provide an electrical impulse through lead 46. Thus, the counter, which includes electro-optical means, as shown in the patent, is responsive to the passage of each individual article, or more specifically to the leading edge thereof, so as to be useful in counting said articles as they pass. Other types of counters can be used instead of the counters shown in the Dutro patent, but tests have proved this to be especially effective in this type of usage.

Output conveyor means 50 comprises a pair of rollers 51, 52 which drive belts 53, 54, 55. Articles are conveyed by the output conveyor means to a point of disposition (not shown).

Retention means 60 is disposed above the output conveyor means and is supported by the frame through a pair of tracks 61, 62. Each of the tracks is mounted to a respective side plate, and includes an upper and a lower rail to trap between them a pair of flanged wheels 63, 64, 65 and 66. Edge stiffeners 67, 68 support a table 69 between them. The wheels are journaled to the edge stiffeners. The table is thereby mounted for reciprocable movement along axis 24. The tracks are engageable by both the top and the bottom of the wheels, but not by both simultaneously. There is sufficient play between the wheels and the track that, depending on the load applied, both wheels could roll along the bottom rails, or one might roll on the top rail and the other on the bottom rail.

A pair of auxiliary support fingers 70, 71 are attached to the table. They project beyond the edge 72 of the table, and provide support to articles farther to the left than edge 72. They reduce the sliding friction with the table by reducing the area of contact, and form extensions of the table.

A barrier 73 comprises a pair of tines 74 which are attached to a cross-member 75. The tines do not move relative to axis 24, and serve as means for preventing the movement of articles on the table past them. Extension 74*a* of the tines is at an angle, and this angle preserves some "shingling" of the first members of the stream as they come to bear against the barrier.

A spur path 76 and an output path 77 diverge from each other substantially adjacent to the counting point. The spur path extends from the counting point to the top of the retention means when the retention means are in the position shown in FIG. 1. The output path extends from the counting point along the output conveyor means.

Diverter means 78 includes a diverter 79 which as a finger like extension 80. The diverter is pivotally mounted to the table through a blade 80*a* attached thereto. A pivot 81 is mounted to the blade near the upstream end of the retention means.

Figure 8:
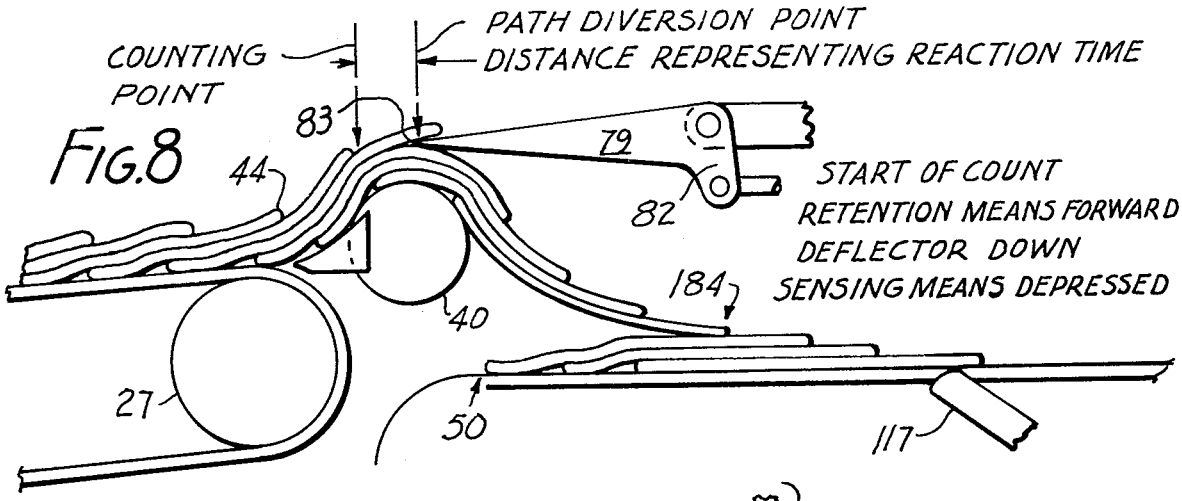
Figure 9:
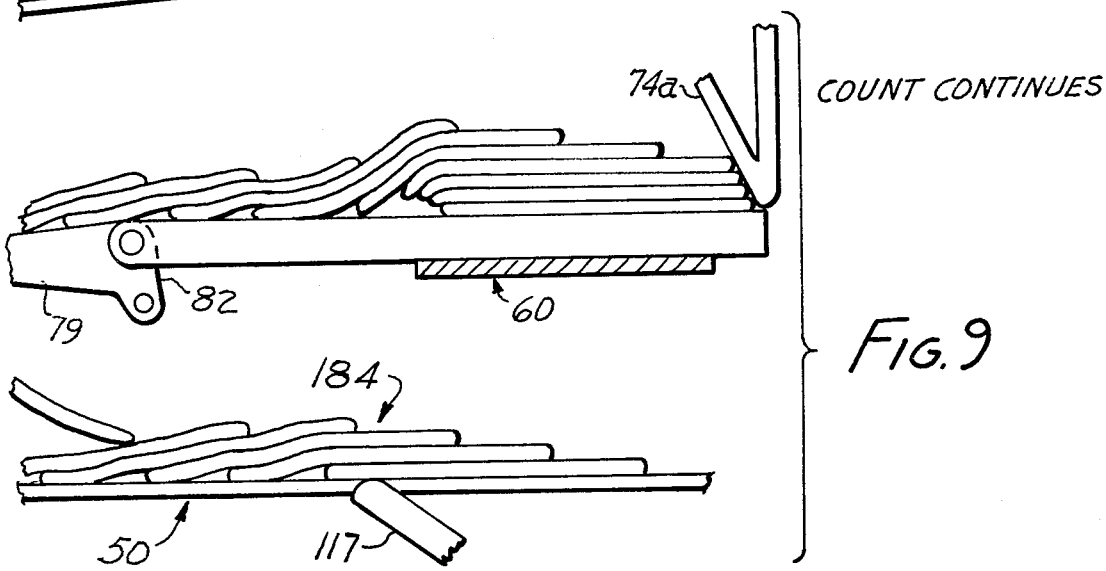
Figure 10:
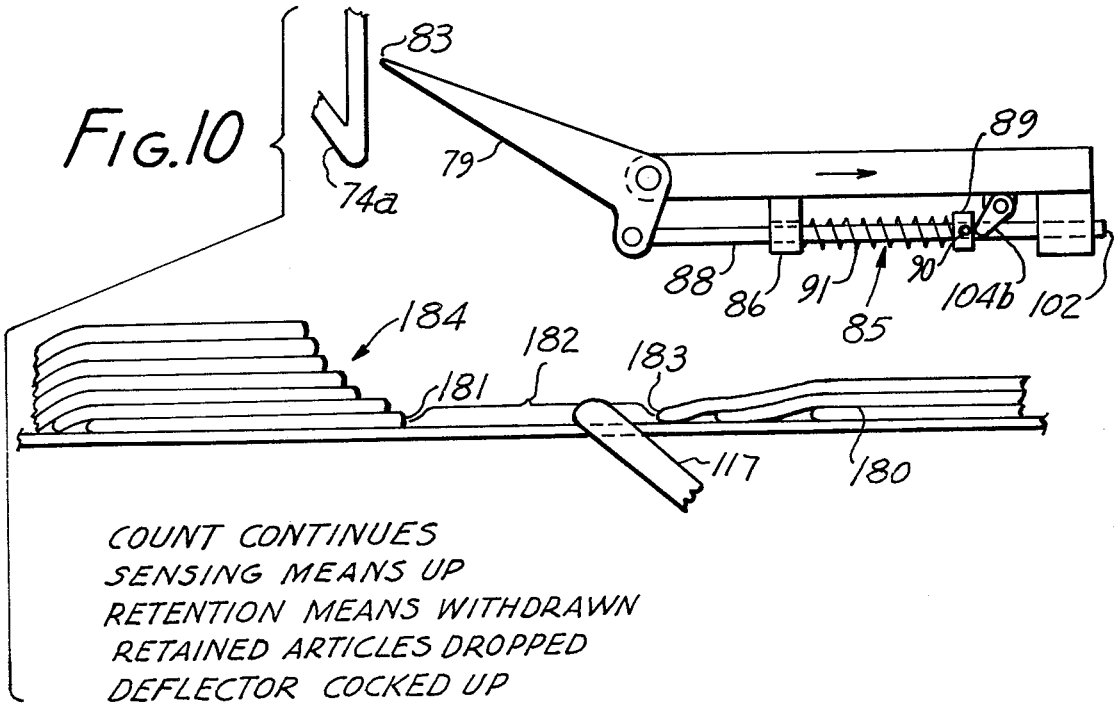

The diverter includes a lever arm 82 by means of which the diverter can be moved between a first position shown in FIG. 2, wherein it is in an upper position and does not act to deflect articles to the spur path, and a lower position shown in FIG. 8, wherein it does divert articles to the spur path.

When in the position of FIG. 8, the tip 83 of extension 80 is in substantial adjacency to the counting point. It is as close to the counting point as is feasible in view of the reaction time involved. The device is usually in fairly high speed operation, and by the time the signal from the counter or counter register indicating completion of the count is transformed into downward movement of the diverter, there will have been some intervening movment of the last article which was counted. Accordingly, the diverter is to drop to its diverting position just after the last-counted article in the previous group has passed it and before the next one reaches it. If the reaction could be instantaneous, then the tip would be disposed exactly at the counting point. Instead, it will be perhaps an inch or so downstream from it. However, this spacing should not be greater than the smallest expected spacing between edges of articles being counted, because it is a considerable advantage of this invention that the stream is diverted immediately after completion of a count, and it is therefore unnecessary to track a counted article downstream, as is customary in much of the known prior art. In fact, the tip will be close enough that the speed of reaction of the diverter can be the same throughout a wide range of conveyor speeds. This dictates substantial adjacency of the counting point and the diverter tip (sometimes, for convenience, the tip is referred to as the diverter itself).

It is necessary to cause the diverter to drop to its second position when a count is completed, and for this purpose, diverter actuator means is provided which is responsive to the counter and to the completion of a count. As is customary in counting articles, a count register 84 is provided, which may be mechanical or electrical, and which receives electro-mechanical or electrical signals as a consequence of each count. A predetermined count is placed in the register, and each count subtracts from it. When the result is zero, the count is complete, and the cycle is repeated. A suitable count register is adjustable to any desired number. The count register is effective to provide a signal when the result is zero, and this will cause the deflector to drop to its second position.

Because a pulse signal is convenient for actuating purposes, it is preferred physically to bias and preload the diverter so that it will tend to move toward the second position unless restrained. This is accomplished by the means best shown in FIGS. 2 and 4.

Figures 3, 4, 5, 7:
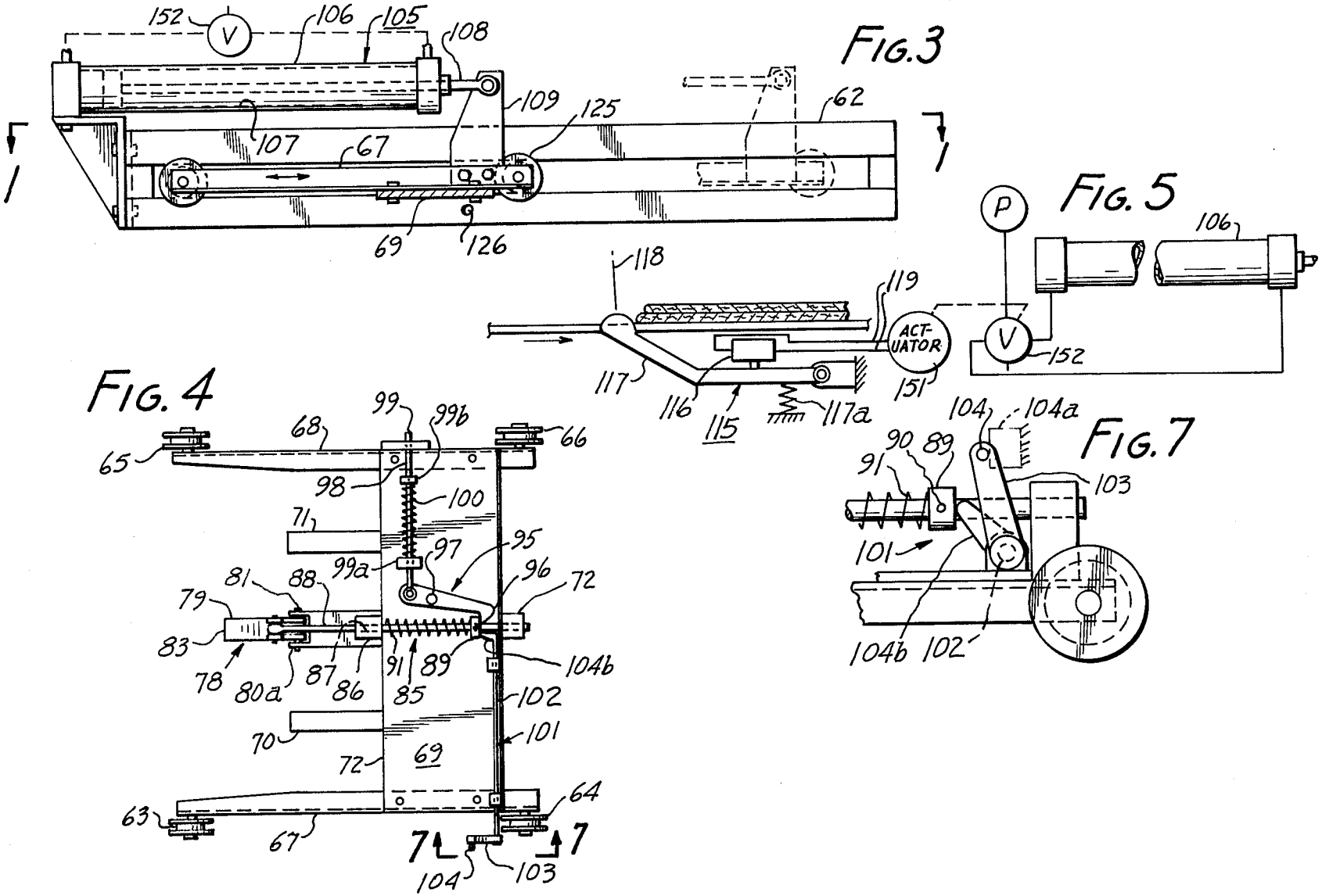
FIG. 3 is a fragmentary section view taken at line 3—3 of FIG. 1.
FIG. 4 is a bottom view of a part of FIG. 1.
FIG. 5 is a fragmentary side view, partly in schematic notation, of a part of FIG. 1.
FIG. 7 is a fragmentary side view taken at line 7—7 of FIG. 4.

A spring means 85 biases the lever toward the second position, as best shown in FIGS. 2 and 4. A support block 86 with a passage 87 therethrough passes a push rod 88 therethrough. The push rod makes a loose fit in passage 87. A collar 89 is pinned to the push rod by pin 90 so as to hold the collar firmly to the push rod. Spring means 85 comprises a coil spring 91 in compression between block 86 and collar 89 biases the push rod to the right in FIG. 2. Because the push rod is attached to lever arm 82, this bias force will, unless restrained, move the diverter to its downward, second, position. The right-hand (downstream) end of the push rod is supported in a passage in another block 92 attached to the underside of the table.

The spring means is latched in the position shown in solid line in FIG. 2 by a latch 95 which is pivotally mounted to the underside of the table (see FIG. 4). This latch includes a latch finger 96 which, in its latching condition, is in interference with collar 89 and will prevent the push rod from moving to the right in FIG. 4. The latch is pivotally mounted by pivot 97 to the underside of the table. A latch-actuating shaft 98 has a tip end 99 to receive an endwise force. A bias spring 100 in compression between a journal 99*a* attached to the table and a collar 99*b* attached to shaft 98 pushes the latch-actuating shaft away from the central axis so as to hold the latch finger in its latched condition. Endwise force on tip 99 will tend to release the latch. A cocking member 101 is mounted to the underside of the table. It has a rotatable crankshaft 102 journaled to the bottom of the table, with one crank arm 103 positioned where a pin 104 will strike a block 104*a* mounted to a side place when the table is retracted to the position shown in dotted line in FIG. 2. Another crank arm 104*b* will then strike collar 89 and move the push rod 88 against spring 91 to its cocked position so that the system will be relatched. Before the table is moved from its solid line to its dotted line position in FIG. 2, the diverter will have been lowered, as will later be disclosed.

Table shifting means 105 includes a linear actuator 106 in the form of a conventional piston-cylinder fluid motor, which may be actuated by compressed air. The cylinder 107 is mounted to one of the side plates, and the piston rod 108 is pinned to a plate 109 that is attached to edge stiffener 67. Therefore, actuation of the linear actuator will cause the table to shift between the two positions shown in FIG. 2. The barrier does not move in this embodiment. The effect of withdrawing the table behind the barrier is to strip articles which were stored in the spur path and to drop them directly onto the output conveyor means.

Sensing means 115 comprises a switch 116 with a switch blade 117 that is biased upwardly by a bias spring 117*a* to project in the output path between belts 53 and 54 unless it is held down (see FIG. 2). The blade will be depressed by articles at its location 118. Location 118 is downstream from the place on the output conveyor means where articles will drop from the retention means, i.e., downstream from the barrier.

A pair of electrically conductive leads 119 are connected to an electrical actuator 151 for a four-way selector valve 152, which controls the position of the table by connecting appropriate ends of the cylinder to pressurized air and exhaust, respectively. When the blade is depressed by articles at the location, the table will be shifted to the position shown in solid line. When it is up, in the absence of an article to hold it down, the table will be shifted to the position shown in dashed line. This control system is a simple two-position switch, and four-way selector valve combination, and the table position accordingly is alternative. In function, the departure of the last article in an already-counted group enables the blade to rise and change the system condition. In order to release the cocked and spring-loaded diverter so it can move to its lower, second, position and divert the stream of articles to the spur path, means is provided to exert an endwise force on the tip end 99 of latch-actuating shaft 98. Such means comprises a pneumatic plunger assembly 125 which is mounted to a side plate of the frame and has access to tip end 99 when the retention means is in the solid line position of FIG. 1. A hole 126 provides this access to pass plunger 127 in order that it can press against tip 99 when the diverter means is to be unlatched. When the count register provides a signal to the plunger assembly indicative of the completion of a count, the plunger 127 is caused to exert an end force on tip end 99 to release latch 95, thereby permitting the bias spring to move the diverter to its second, diverting, position.

Figures 6, 11, 12, 13:
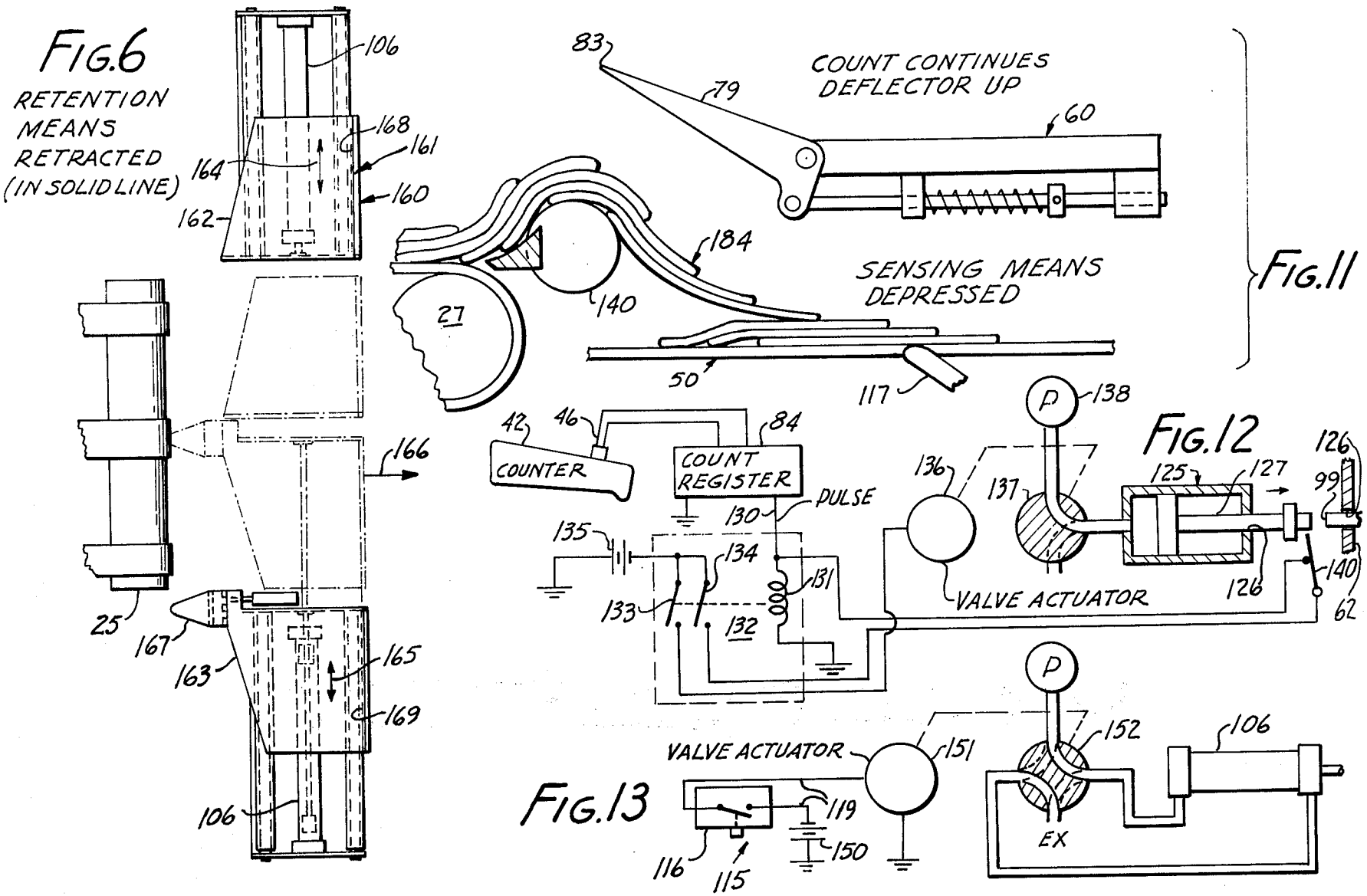
FIG. 6 is a top view showing an alternate construction for a portion of the apparatus of FIG. 1.
FIGS. 8–11 are fragmentary side views showing a sequence of events in the operation of this apparatus.
FIGS. 12 and 13 show circuitry and schematically illustrated components as used in the apparatus of FIG. 1.

One suitable means for causing the pulse from a count register to actuate the plunger assembly is shown in FIG. 12. The counter 42 provides a pulse to lead 46 each time an article is counted. This pulse is provided to a count register 84 which, when the preselected count is reached, provides an electrical pulse to lead 130. This pulse energizes winding 131 of relay 132. This closes two normally-closed relay switches 133, 134. Relay 133 is a power switch to convey power from a battery 135 or other source of electricity to a two-position valve actuator 136. The valve actuator occupies one position when it is electrically energized, and another when it is not.

The actuator sets a three-way selector valve 137 to the solid line position when energized, and to the dashed line position when it is not. When energized, fluid from a source 138 is fed to plunger assembly 125. In the other position, the plunger assembly is vented.

The switch 134 is a latch switch. It is in series with a normally-closed breaker switch 140, which is opened when the plunger 127 is fully extended so as to break a latch circuit through switches 134, 140 and winding 131. The net effect is for a pulse from the count register to energize winding 131, close switches 133 and 134, actuate the valve actuator to set valve 137 to pass compressed air to the plunger assembly, and extend the plunger to contact tip end 99 and release the latch. Plunger movement opens switch 140 and breaks the latch. The valve actuator returns valve 137 to the vented (dashed line) condition and returns the plunger to await the next cycle.

One suitable means for cycling the retention means is shown in FIGS. 5 and 13. Switch 116 is connected to a battery 150 or other source of electricity. In turn, this normally-open switch is connected to a valve actuator 151, which has one position when actuated, and another when it is not.

Actuator 151 controls a four-way valve 152 which has two positions, shown schematically in solid and dashed lines. In one position, it provides compressed air to one side of the linear actuator 106, and vents the other. In the other position, the connections are reversed. Therefore, the linear actuator's position is to one extreme or the other as a function of whether switch 115 is open or closed. This in turn is a unique function of the presence or absence of articles on the output path to hold down the blade 117 or to let it rise.

FIG. 6 illustrates that the movement of the retention means can be other than axial; that is, other than in the same general direction as the path. In FIG. 6, retention means 160 comprises a table 161 made in two parts 162, 163, which parts are movable laterally as shown by arrows 164, 165. The path direction is shown by arrow 166. Diverter means 167 is mounted to part 163. The barrier in this embodiment is a wall 168, 169 formed on each respective part which moves along with the parts, but prevents path-wise movement of articles past it. The details of diverter movement and of table movement are identical with those of the other FIGS. The only substantial difference is that in FIG. 6 the table moves laterally to drop the articles, rather than axially. The table is shown closed in dashed line, and open in solid line. Linear actuators 106 are shown mounted to the frame and connected to the table parts for moving them. The same circuitry is used to control these actuators as was used in FIG. 5, and the same plunger assembly may be used to release the diverter.

The diverter means will be adapted to be re-cocked as a consequence of the sideward movement of the table, rather than path-wise, but this requires no more than a simple additional link. Therefore, the details of this mechanism are not shown here.

As an optional means for cocking the deflector, a body can be attached to the frame where it will be struck by the tip 83 of the push rod 88. This can be substituted for the rotational means illustrated in FIG. 4.

The operation of this device will now be summarized, much of it already being evident from the foregoing. A stream of overlapped articles is provided to the counting point by means of the infeed conveyor means. The count register will have been set to some predetermined count desired for a group, and this count can be different from group to group, depending on the arrangement and complexity of the count register. The counter begins to count the edges of the articles as they pass beneath its nose. FIG. 2 indicates the situation of a continuing count, which has not been completed, but wherein a previous group 180 of articles has cleared the sensing means. The lead articles 181 of a subsequent group, which articles 181 were previously retained on the retention means, has been dropped from the table onto the output conveyor means, and has moved to depress the blade of the sensing means. As a consequence, the table will have moved to the left with the diverter in the upper position awaiting the completion of the on-going count. A gap 182 will have been formed between the trailing edge 183 of group 180 and the leading articles 181 of the following group 184.

When the count is completed, as indicated by a pulse from the count register, the plunger assembly 125 is caused to be actuated, and its plunger strikes tip end 99 to release the latch, lowering the diverter and diverting subsequent articles to the spur path. The subsequent articles will be counted as part of the next group, and the remainder of the already-counted articles will proceed along the output path, holding down the sensing means until the last of them has passed it. At that time, the sensing means will change its condition, retracting the table and dumping the next group on the output conveyor means with a gap formed between the first members of this group and the last of the previous group. When the table retracts, the diverter is again moved upwardly, as shown in dashed line in FIG. 2. As soon as the next articles have depressed the sensing means, the table is returned to its solid line position, with the diverter up, there to await the completion of the next count and the lowering of the diverter.

A more detailed schematic sequence is shown in FIGS. 8-11, illustrating the relative positions of the diverter and the table relative to the stream.

The rollers are driven by motor means 190.

The table has two positions. One is an "article-supporting position" above the output path. This is shown in solid line in FIG. 2 and in dashed line in FIG. 6. In this position, the table lies along at least part of the spur path. The other position is a "non-supporting position". This position is shown in dashed line in FIG. 2 and in solid line in FIG. 6. The table is positioned where it does not support articles above the output path. The table is withdrawn from the spur path in both arrangements. In FIG. 2, it is moved parallel to the path beyond the barrier. In FIG. 6 it is moved laterally relative to the path. The diverter means is movably mounted to the table in such a manner that, when the table is in its article-supporting position, the diverter means can either be placed in the article stream adjacent to the counting point, or be placed outside of the stream.

The result of all the foregoing is an elegantly simple device manufactured of rugged and simple parts which are easy to assemble and maintain, but which provides a completely reliable counting mechanism for counting the members of articles in groups, and providing a separation in the path between adjacent groups.

This invention is not to be limited by the embodiments shown in the drawings and described in the description, which are given by way of example and not of limitation, but only in accordance with the scope of the appended claims.

We claim:

1. A separator for forming spaced-apart groups of counted members from a stream of initially overlapped articles, comprising: output conveyor means defining an output path; retention means including a table adapted to be positioned in an article-supporting position above the output conveyor means, and to be moved therefrom to a non-supporting position, said article-supporting supporting position including at least part of a spur path, said paths diverging downstream from, and substantially adjacent to, a counting point; diverter means movably mounted to said table having a first position wherein it does not enter the stream to divert articles to the spur path, and a second position where it does enter the stream at a point substantially adjacent to the counting point whereby to divert the stream to the spur path and onto the table when the table is in its article-supporting position; counter means counting articles passing the counting point; diverter actuator means responsive to the completion of a count to cause the diverter to move to its second position; means to return the diverter to its first position; sensing means sensing the absence of articles from a location along the output path; means responsive to said sensing means to cause the table to move to its non-supporting position and transfer articles in the spur path to the output path, the sensing means being disposed downstream from the place where articles are received on the output path from the spur path, whererby at the start of a count, the diverter means diverts the stream of articles to the table in the spur path with the table in its article-supporting position while the output conveyor means conveys away an already-counted group of articles, the sensing means sensing the presence of articles at its location until the last article of the already-counted group has passed it, whereupon the responsive means moves the table to its non-supporting positon to cause the said transfer and removes the diverter means from the stream, whereby all articles thereafter pass to the output path, and the means to return the diverter to its first position do so, and when an article again reaches the sensing means, the table is moved to its article-supporting position in the spur path, completion of a predetermined count causing the aforesaid cycle to repeat.

2. A separator according to claim 1 in which the diverter is a pivoted member pivotally mounted to the table so disposed and arranged as to be inserted in the stream between the last-counted article in an already-counted group, and the first article in the group next yet to be counted.

3. A separator according to claim 1 in which the retention means includes a barrier positioned in the spur path to limit the distance any article can travel thereon, and in which the means responsive to the sensing means comprises table shifting means adapted to place the table beneath said spur path in its article-supporting position and to remove it therefrom in its non-supporting position, the articles retained on the table dropping onto the output conveyor means when the table is removed.

4. A separator according to claim 3 in which the table is movable in a direction generally aligned with the spur path.

5. A separator according to claim 3 in which the table is movable in a direction generally lateral to the spur path.

6. A separator according to claim 1 in which the means to return the diverter comprises springing means which biases the diverter means toward its second position, and in which releasable latch means holds the diverter means in its first position, and in which the diverter actuator means comprises a latch-release means actuated at the completion of a count to release the latch and thereby enable the diverter to move to the second position.

7. A separator according to claim 6 in which the diverter actuator means comprises a driven plunger, power to actuate the same being derived from a signal from the counter means that a predetermined count of articles has passed the counter.

8. A separator according to claim 6 in which the counter means includes a register that is responsive to counts of the counter, and which can be adjusted to be responsive to selected ones of a plurality of counts, and to provide a signal to actuate the diverter actuator means when a pre-selected count has passed the counter.

9. A separator according to claim 1 in which the table is movable in a direction generally aligned with the spur path.

10. A separator according to claim 1 in which the table is movable in a direction generally lateral to the spur path.

11. A separator according to claim 1 in which the diverter, when in its diverting position, is disposed in substantial adjacency to the counting point.

12. A separator according to claim 1 in which the means to return the diverter is a cocking member which is fixed relative to the path of the retention means and is adapted to contact the diverter actuator means, thereby to move the diverter to its first position, and to permit the latch means to hold it in that position.

13. A separator according to claim 1 in which the sensing means and the means responsive to said sensing means are so coupled as to cause the table to assume a position in the spur path, or a position outside of the spur path, solely as a function of the presence or absence of an article relative to the sensing means.

14. A separator according to claim 1 in which the diverter is in its first position only after a previous count has passed the sensing means.

15. A separator according to claim 14 in which the sensing means and the means responsive to said sensing means are so coupled as to cause the table to assume a position in the spur path, or a position outside of the spur path, solely as a function of the presence or absense of an article relative to the sensing means.

16. A separator according to claim 3 in which the barrier slants toward the oncoming articles.

17. A separator according to claim 3 in which the diverter is a pivoted member pivotally mounted to the table so disposed and arranged as to be inserted in the stream between the last-counted article in an already-counted group, and the first article in the group next yet to be counted.

18. A separator according to claim 6 in which the diverter is a pivoted member pivotally mounted to the table so disposed and arranged as to be inserted in the stream between the last-counted article in an already-counted group, and the first article in the group next yet to be counted.

19. A separator according to claim 8 in which the diverter actuator means comprises a driven plunger, power to actuate the same being derived from a signal from the counter means that a predetermined count of articles has passed the counter.

* * * * *

UNITED STATES PATENT OFFICE

CERTIFICATE OF CORRECTION

Patent No. 3,948,153 Dated April 6, 1976

Inventor(s) ORVILLE V. DUTRO ET AL

It is certified that error appears in the above-identified patent and that said Letters Patent are hereby corrected as shown below:

| | |
|---|---|
| Col. 4, line 8 | "as" should read --has-- |
| Col. 4, line 9 | "finger like" should read --finger-like-- |
| Col. 8, line 43 | cancel "supporting" second occurrence |
| Col. 8, line 63 | "whererby" should read --whereby-- |

Signed and Sealed this

Fourth Day of January 1977

[SEAL]

*Attest:*

RUTH C. MASON
*Attesting Officer*

C. MARSHALL DANN
*Commissioner of Patents and Trademarks*